US007207827B2

(12) United States Patent
Saka

(10) Patent No.: US 7,207,827 B2
(45) Date of Patent: Apr. 24, 2007

(54) AUTOMOTIVE ELECTRICAL CONNECTOR BOX

(75) Inventor: Yuuji Saka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 11/000,189

(22) Filed: Dec. 1, 2004

(65) Prior Publication Data

US 2005/0118857 A1 Jun. 2, 2005

(30) Foreign Application Priority Data

Dec. 2, 2003 (JP) ..... 2003-403584

(51) Int. Cl.
*H01R 4/24* (2006.01)

(52) U.S. Cl. ..... 439/395

(58) Field of Classification Search ..... 439/395, 439/397, 404, 408, 400
See application file for complete search history.

(56) References Cited

U.S. PATENT DOCUMENTS 3,186,472 A * 6/1965 Caravella ..... 126/42
4,407,557 A * 10/1983 Hayes ..... 439/404
4,527,852 A * 7/1985 Dechelette ..... 439/408
4,548,459 A * 10/1985 Mosser, III ..... 439/443
5,616,047 A 4/1997 Lutsch
5,653,607 A 8/1997 Saka et al.
6,908,331 B2 * 6/2005 Brown ..... 439/395

FOREIGN PATENT DOCUMENTS

| | | |
|---|---|---|
| EP | 0692850 | 3/2003 |
| JP | 7-302670 | 11/1995 |
| JP | 8-045570 | 2/1996 |
| JP | 2001-135151 | 5/2001 |

OTHER PUBLICATIONS

English language Abstract of JP 8-045570.
English language Abstract of JP7-302670.
English language Abstract of JP2001-135151.

* cited by examiner

*Primary Examiner*—Phuong Dinh
(74) *Attorney, Agent, or Firm*—Greenblum & Bernstein, P.L.C.

(57) ABSTRACT

An electrical connector box including a pressure contact terminal to connect to electrical wires of various diameters. A container including an upper case and lower case houses electrical wires which are gripped by slots of pressure contact terminals. Either a thick wire, which includes a core wire including multiple twisted strands, or a thin wire, which includes a single core wire, are able to connect to the uniform width slots of the pressure contact terminals.

8 Claims, 9 Drawing Sheets

AUTOMOTIVE ELECTRICAL CONNECTOR BOX

CROSS REFERENCE TO RELATED APPLICATIONS

The present disclosure relates to subject matter contained in priority Japanese Application No. 2003-403584, filed on Dec. 2, 2003, which is herein expressly incorporated by reference in its entirety.

BACKGROUND OF THE INVENTION

1. Field of the Invention

The invention relates to an automotive electrical connector box, and more particularly, to an automotive electrical connector box including pressure contact terminals connecting terminals that grip electrical wires of varying diameter.

2. Description of Background Information

As shown in FIG. 9, a conventional automotive electrical connector box is disclosed by Japanese Kokai (Laid Open) Patent No. 8-45570. In the conventional automotive electrical connector box, electrical wires are gripped by pressure contact terminals, each electrical wire including a core conductor enveloped by a layer of insulating material. This structure incorporates wire channels 2 and 3 formed to accommodate the diameter of wires located within insulator plate 1 in the electrical connector box, and the different diameters of wires w2 and w1 that are routed within wire channels 2 and 3. Small diameter wire w2 is pressed into slot 4*a* (which has the same diameter as wire w2) of small wire pressure contact terminal 4, and large diameter wire w1 is pressed into slot 5*a* of large wire pressure contact terminal 5, slot 5*a* having a greater width than slot 4*a*. In other words, each pressure contact terminal is constructed to a specific dimension for connection to a wire of corresponding diameter which is pressed therein.

This structure of the prior art, however, necessitates that the pressure contact terminals be formed to sizes corresponding to the various diameters of the wires to be mounted in the electrical connector box. This is a shortcoming that results in high cost and a large number of electrical box components.

SUMMARY OF THE INVENTION

In light of the above described shortcomings, the automotive electrical connector box of the present invention is constructed to lower manufacturing costs and reduce the number of components through the use of commonly dimensioned pressure contact terminals to which electrical wires of varying diameter may be connected.

To solve the shortcomings of the prior art, the present invention provides an automotive electrical connector box constructed of a case containing electrical wires, each of the wires constructed as a core wire covered by an insulating material, and each wire inserted into a slot of a pressure contact terminal and gripped therein. The slots are constructed with a common width into which a thick insulated electrical wire having a core constructed of multiple twisted strands may be inserted, or into which a thin insulated electrical wire having a core constructed of a single wire strand may be inserted.

Because the core of the thick wire is formed of multiple twisted wire strands, the above-described construction of the present invention allows the thick wire to be inserted into the slot of a pressure contact terminal dimensioned to connect to a thin wire by compressing the cross section of the thick wire into an oval shape, thus making it possible to connect either a thick wire or a thin wire to a commonly dimensioned thin wire pressure contact terminal. This construction is therefore able to lower the manufacturing cost of the pressure contact terminal and reduce the number of components, thereby simplifying the pressure contact terminal and wire connecting process because either a thick wire or a thin wire can be connected to pressure contact terminals having a common slot width. For example, a thick electrical wire with a 0.85 $mm^2$ cross sectional area and a core wire strand diameter of between 0.24 mm and 0.4 mm may be made with 7 to 19 core wire strands. Manufacturing cost will increase if the core wire strand diameter is less than 0.24 mm due to the increased number of strands, and a core wire strand diameter greater than 0.4 mm will result in fewer core strands which will make it more difficult to compress the wire when inserted into the pressure contact terminal. Moreover, while the pressure contact terminals are constructed with a common slot width for connection to a thick or thin wire, it is preferable that the pressure contact terminals be constructed with uniform shape and dimension.

Though the core of the thick wire may be from 1.5 to 3 times larger in cross section than that of the thin wire, it is preferable that it be from 1.5 to 2 times larger in cross section. If the cross sectional area of the thick core wire were less than 1.5 times larger than that of the thin wire, there would be no need to form the core from twisted wire strands as it would be possible to insert a single core wire of this size into the thin wire pressure contact terminal. If the cross sectional area of the thick core wire were more than 1.5 times larger than that of the thin wire, an excessive amount of force would be required to press the wire into the slot, or insufficient compression of the cross section would prevent insertion of the wire.

It is preferable that the automotive electrical connector box of the present invention be constructed so that the electrical wires are placed in wire guide channels formed on an inner surface of the case or on an insulator board provided within the case, and that houses the pressure contact terminals within pressure contact terminal chambers formed on the case or insulator board. It is preferable that the structure of the present invention also include closing walls that define an electrical wire insertion space at the open end of the slot at the pressure contact terminal chamber, and that the electrical wire insertion space be formed to a width approximately equal to the diameter of the thin wire, thus having the effect of compressing the thick wire to the same width as the diameter of the thin wire to allow the thick wire to be pressed into the slot.

With the above noted construction of the present invention, to press the thick wire into the pressure contact terminal in the wire guide channel, the thick wire first passes through the wire insertion space which has a width approximately equivalent to the diameter of the thin wire. The thick wire is compressed between the closing walls within a space having a width approximately equal to the diameter of the thin wire, thus making it possible to insert the thick wire into the slot of a thin wire pressure contact terminal. The thick wire is thus able to be pressed into the slot without the application of excessive force and without damaging the pressure contact terminal.

The wire guide channel is formed from two walls projecting outwardly from the inner surface of the case or from the insulator board. The pressure contact terminal chamber is formed as a widened space between the two walls, and closing walls formed at the top of the two walls define a wire insertion space for the insertion of the electrical wire. The electrical wire, which has been placed in the wire guide channel, passes through the wire insertion space, and is pressed into and gripped by the slot of the pressure contact terminal. An external connector part of the pressure contact terminal, which projects from the other end of the pressure contact terminal chamber, connects to terminals contained in the connector compartment, fuse compartment, or relay compartment formed on the external surface of the case.

The above noted construction of the present invention makes it possible to connect either a thick wire or a thin wire to terminals in the connector, fuse, and relay compartments, which are formed on the external case surface, through one type of thin wire pressure contact terminal.

As noted in the previous descriptions, the present invention makes it possible to press a thick wire into a thin wire pressure contact terminal because the thick wire, which has a core of multiple twisted wire strands, is compressed into an oval shaped cross section that allows it to be pressed into the slot of a pressure contact terminal having a slot width dimensioned for the insertion of a thin wire. Thus, a thin wire pressure contact terminal may be employed to grip either a thin wire or thick wire. The advantages are at least reduced manufacturing costs, fewer components, and simplified assembly of the electrical connector box through the ability to insert either a thick or thin electrical wire into pressure contact terminals having a common slot width.

An aspect of the present invention provides an electrical connector box including a case to house insulation covered electrical wires, the electrical connector box including at least one pressure contact terminal provided in the case, each pressure contact terminal including a slot to grip an electrical wire and make connection thereto; wherein each the slot is configured having a first width dimension, the first width dimension accommodating a thick insulated electrical wire or a thin insulated electrical wire. Further, each slot is configured to grip a thick insulated electrical wire or a thin insulated electrical wire. Each slot is configured to grip a thick insulated electrical wire having a core formed of multiple twisted strands or a thin insulated electrical wire formed of a single strand.

In a further aspect of the present invention, the electrical connector box further includes a plurality of pressure contact terminals provided in the case, each slot configured to a common width dimension configured to grip a thick insulated electrical wire having a core formed of multiple twisted strands or a thin insulated electrical wire formed of a single strand. Further, the electrical connector box is configured to be received in an automobile.

the thick wire includes a cross sectional area 1.5 to 3 times larger than the cross sectional area of the thin wire. Further, the electrical connector box may include an insulator board provided in the case, the insulator board including wire guide channels configured to route the electrical wires therealong; pressure contact terminal chambers provided on the case or the insulator board, the pressure contact terminals contained within the pressure contact terminal chambers; and closing walls defining an electrical wire insertion space at an open end of the slot at the pressure contact terminal chambers; wherein the electrical wire insertion space is configured to a width substantially equal to the diameter of the thin insulated electrical wire; and wherein the thick electrical wire may be pressed into one of the slots after being compressed to the same diameter as the diameter of the thin electrical wire. Further, the insulator board is provided on inner surface of the case or within the case. The electrical connector box may further include wire guide channels configured to route the electrical wires therealong, the wire guide channels including two walls projecting from an inner surface of the case or from the insulator board; pressure contact terminal chambers provided on the case or the insulator board, the pressure contact terminals contained within the pressure contact terminal chambers, the pressure contact terminal chambers being formed as a widened space between the two walls; closing walls provided at the top of the two walls defining a wire insertion space for insertion of the electrical wire; wherein the electrical wire in the wire guide channel may be compressed by passing through the wire insertion space and pressed into the slot of the pressure contact terminal to make contact therewith; and an external connector portion of the pressure contact terminal, the external connector portion projecting from an end of the pressure contact terminal chamber and configured to connect to terminals contained in a connector compartment, fuse compartment, or relay compartment on an external side of the case. Further, the wire guide channels include two walls projecting from an inner surface of the case. The wire guide channels include two walls projecting from the insulator board.

A further aspect of the present invention provides an electrical connector box including a case to house insulation covered electrical wires, the electrical connector box including a plurality of pressure contact terminals provided in the case, each pressure contact terminal including a slot to grip an electrical wire and make connection thereto, each slot configured to a common width dimension configured to grip a thick insulated electrical wire having a core formed of multiple twisted strands or a thin insulated electrical wire formed of a single strand; and an external connector portion, the external connector portion configured to connect to terminals contained in a connector compartment, fuse compartment, or relay compartment on an external side of the case.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe embodiments of the invention with reference to the drawings. FIGS. 1 through 6 illustrate the first embodiment of the invention.

Figure 1:
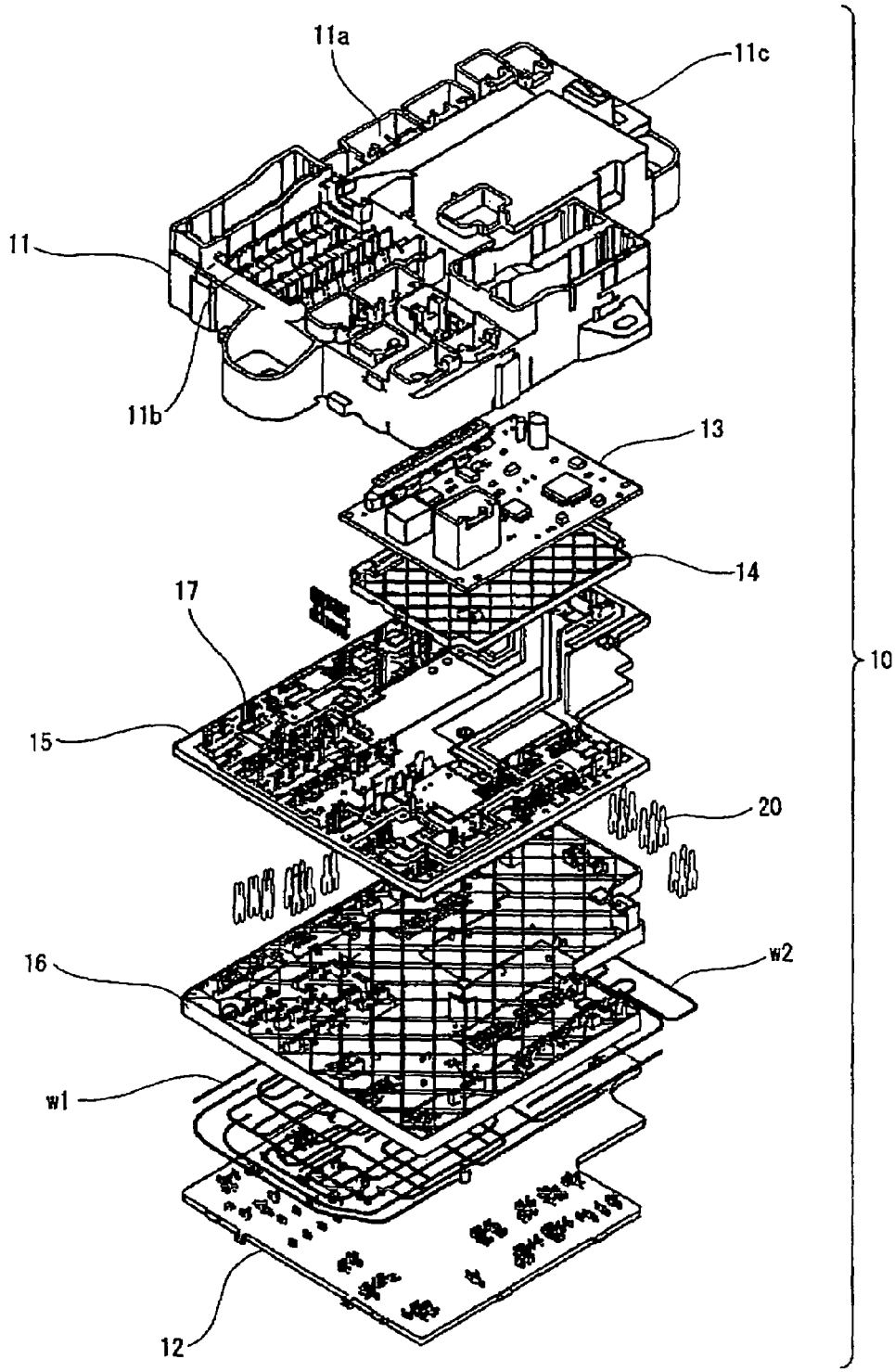
FIG. 1 is an exploded perspective view of the electrical connector box of a first embodiment of the present invention.

As illustrated in FIG. 1, electrical connector box 10 includes printed circuit board 13 and resin insulator boards 14, 15, and 16 arranged in layers within a container structure formed by upper case 11 and lower case 12 which are made from a synthetic resin material. Thick electrical wire w1 and thin electrical wire w2 (hereafter referred to as thick wire w1 and thin wire w2) are positioned on the underside of insulator board 16 and gripped by commonly dimensioned pressure contact terminals or insulation displacement terminals 20 which are able to grip either thick wire w1 or thin wire w2. Connector compartment 11*a*, fuse compartment 11*b*, and relay compartment 11*c* are formed on an external side of upper case 11. Moreover, bus bar 17, which has been press-blanked and bend-formed to the required shape from electrically conductive sheet metal, is fixedly crimped to insulator board 15.

Figure 2A:
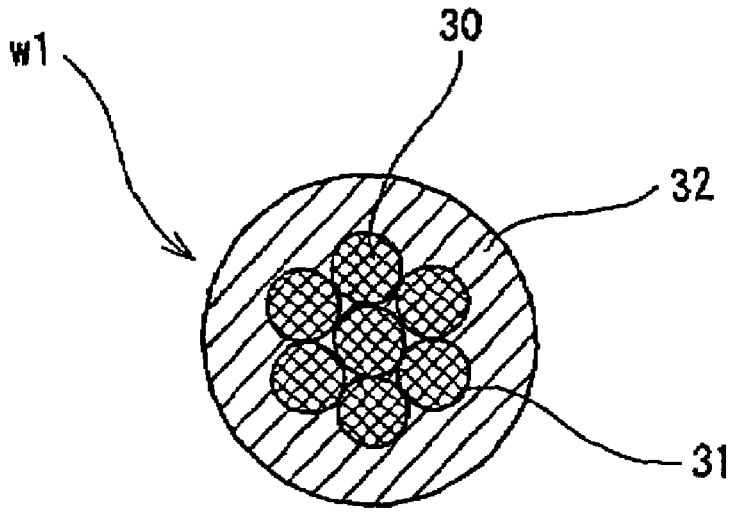
FIG. 2A is a cross sectional view of a thick wire of the embodiment of FIG. 1.
Figure 2B:
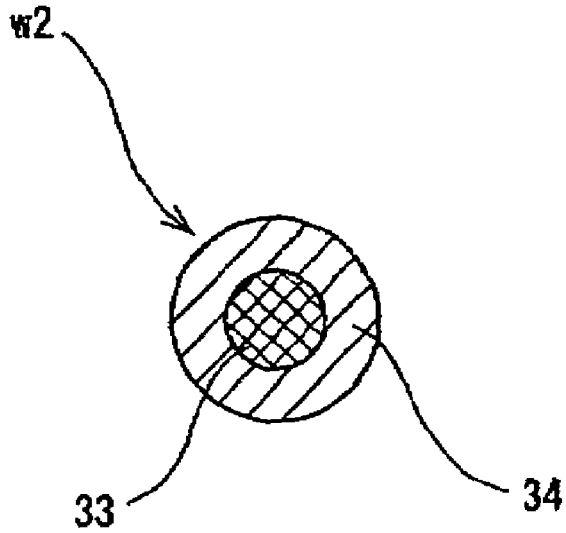
FIG. 2B is a cross sectional view of a thin wire of the embodiment of FIG. 1.

As shown in FIG. 2A, thick wire w1, which is enclosed within electrical connector box 10, has a cross sectional area of 0.85 $mm^2$ and includes core wire 31, which is formed by twisting together multiple wire strands 30, and insulating sheath 32 which encloses core wire 31. The core wire 31 of the present invention includes a plurality of wire strands 30, and in the present embodiment, includes seven wire strands 30, each having a diameter of 0.4 mm, twisted together to form core wire 30. As shown in FIG. 2B, thin wire w2, which has a cross sectional area of 0.5 $mm^2$, includes single core wire 33 which is enclosed within insulator sheath 34. In this embodiment, the cross sectional area of core wire 31 of thick wire w1 is 1.7 times larger than that of single core wire 33 of thin wire w2.

Figure 3:
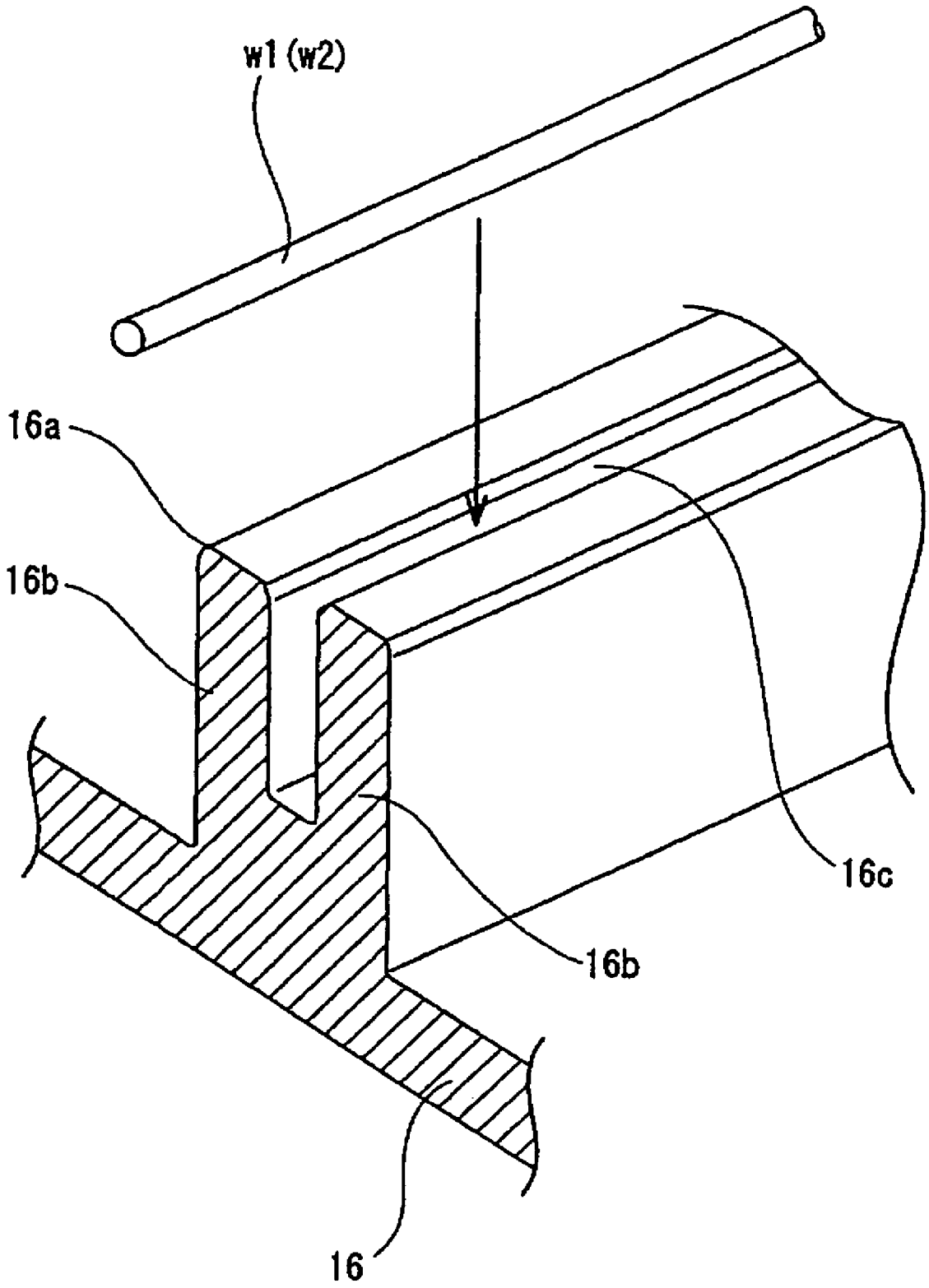
FIG. 3 is a perspective view of the configuration of a wire laid out in the wire guide channel formed on the insulator board in the embodiment of FIG. 1.
Figure 4:
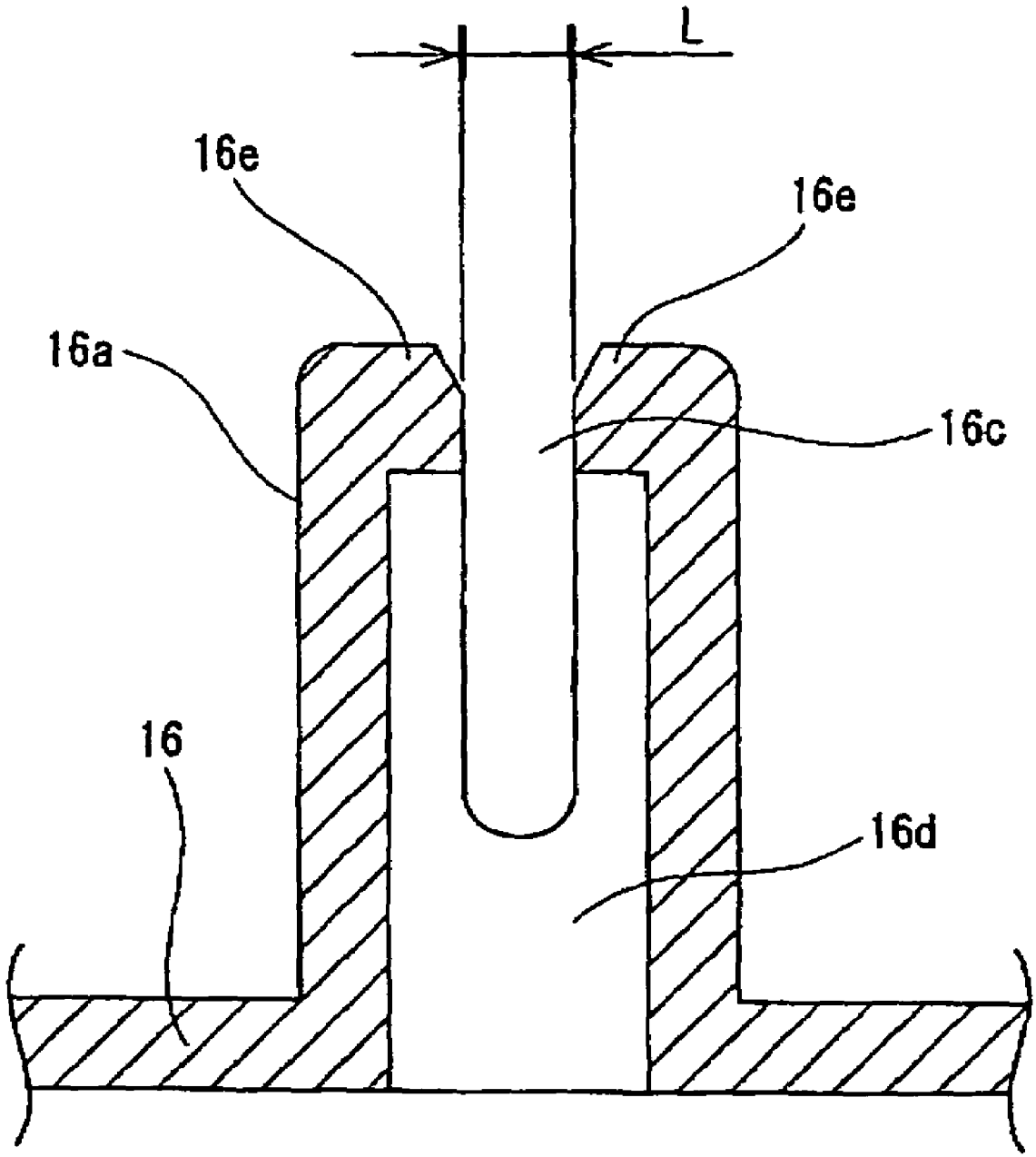
FIG. 4 is a cross sectional view of the pressure contact terminal chamber within the wire guide channel in the embodiment of FIG. 1.

As shown in FIG. 3, channel walls 16*b*, which define wire guide channel 16*a* along which thick wire w1 and thin wire w2 are provided, are formed on the underside of insulator board 16. Wire insertion space 16C provides an opening at the top portion of channel walls 16*b*. FIG. 4 illustrates pressure contact terminal chamber 16*d* which is defined by the space between channel walls 16*b*, and squeeze walls 16*e* formed at the opening to wire insertion space 16C which connects to the top of pressure contact terminal chamber 16*d* between channel walls 16*b*. Width dimension "L" of wire insertion space 16*c* is of approximately the same width as the diameter of thin wire w2.

Figure 5A:
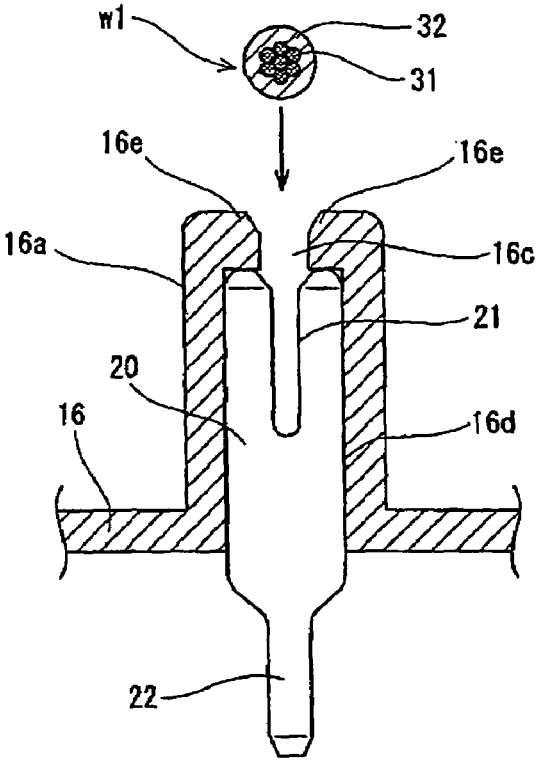
FIGS. 5A, 5B, and 5C are cross sectional views showing the insertion sequence of a thick wire into the pressure contact terminal in the embodiment of FIG. 1.

As illustrated in FIG. 5A, pressure contact terminal 20, which is provided within pressure contact terminal insertion chamber 16*d* of wire guide channel 16*a*, includes slot 21 provided on one end, and external terminal connector 22 formed on the other end. The slot 21 may be provided in any suitable manner, and in the present embodiment, the slot 21 is formed as a cut out portion of the pressure contact terminal 20. The width dimension of slot 21 is established to match the diameter of thin wire w2. Therefore, when thin wire w2 is inserted into slot 21, the edges of slot 21 cut through insulation sheath 34 of thin wire w2 to make contact with core wire 33.

Figure 5B:
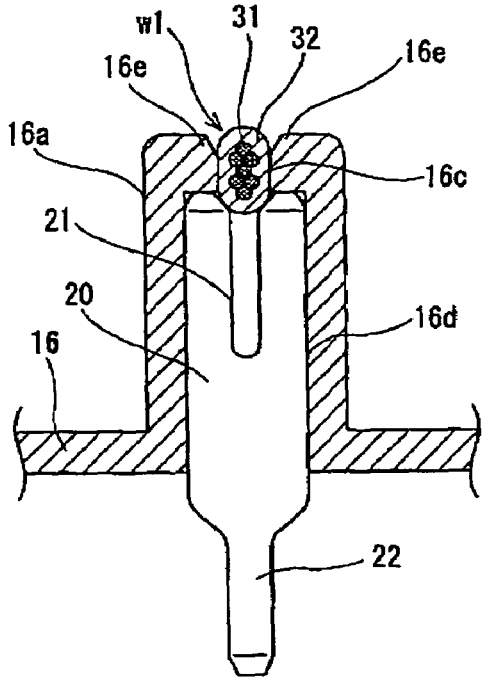
Figure 5C:
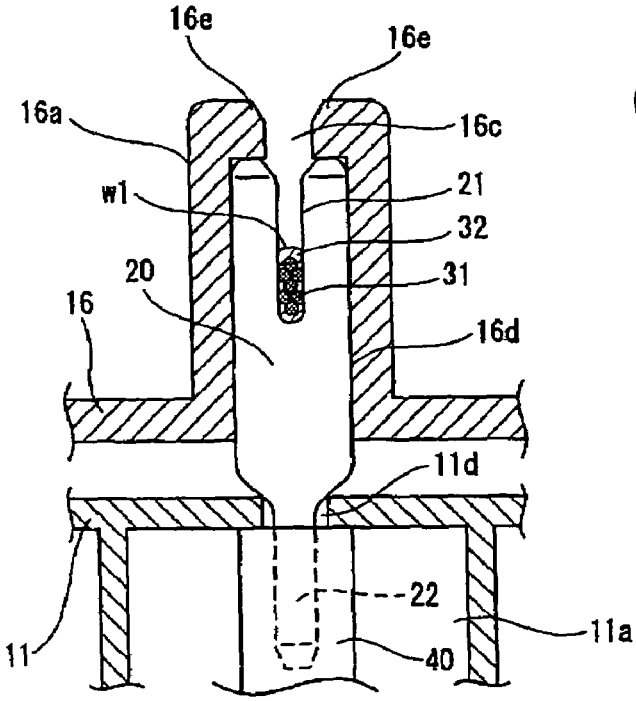

As illustrated in FIG. 5A, the connection between thick wire w1 and pressure contact terminal 20 is established through a construction whereby pressure contact terminal 20 is provided and securely maintained in pressure contact terminal chamber 16*d* with slot 21 facing wire insertion space 16*c* to allow the insertion of thick wire w1 into wire guide 16*a* through wire insertion space 16*c*. As shown in FIG. 5B, width dimension "L" of wire insertion space 16*c* is narrower than the diameter of thick wire w1. Therefore, when thick wire w1 is inserted between squeeze walls 16*e*, the pressure applied by squeeze walls 16*e* compresses the cross section of thick wire w1 into a vertically oriented oval shape. At this point, the width of thick wire w1 is approximately equivalent to the diameter of thin wire w2. Therefore, with thick wire w1 having been inserted into wire guide 16*a* and compressed into the shape shown in FIG. 5B, slot 21 of pressure contact terminal 20 cuts through the insulation sheath of thick wire w1 to make contact with core wire 31 in the same manner as it would if thin wire w2 were inserted. Moreover, in this embodiment, thick wire w1 is inserted into wire guide 16*a* and gripped by pressure contact terminal 20 after pressure contact terminal 20 has been installed into pressure contact terminal chamber 16*d*. Alternatively, pressure contact terminal 20 may be inserted into pressure contact terminal chamber 16*d* and grip thick wire w1 with thick wire w1 already positioned within wire guide 16*a*.

External terminal connector 22 projects from insulator board 16 into connector compartment 11*a*, which is provided on the external side of upper case 11, through connector hole 11*d* in upper case 11, and connects to female terminal 40 of an external electrical wire circuit through a male-female joint. Moreover, external terminal connector 22 may also project into fuse compartment 11*b* and relay compartment 11*c*, as well as into connector compartment 11*a*, and connect to terminals therein.

Figure 6A:
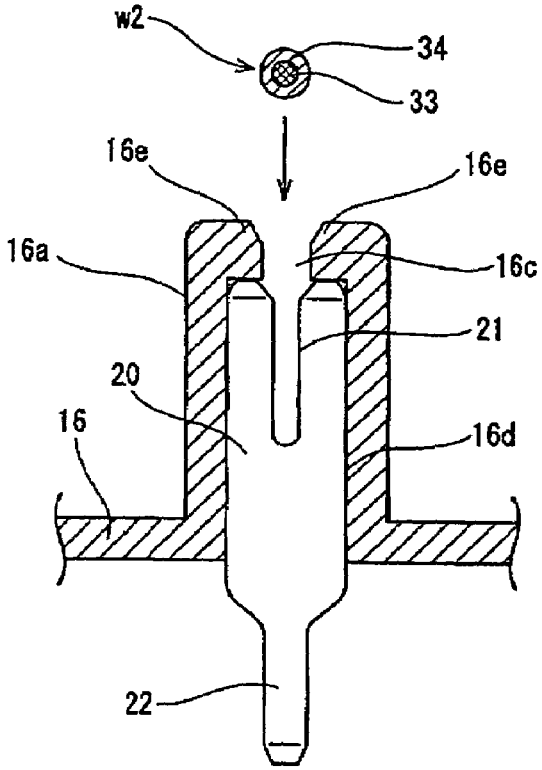
FIGS. 6A, 6B, and 6C are cross sectional views showing the insertion sequence of a thin wire into the pressure contact terminal in the embodiment of FIG. 1.
Figure 6B:
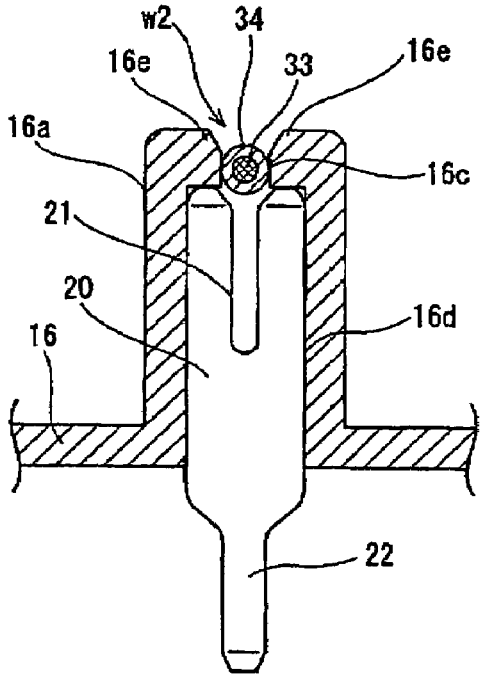
Figure 6C:
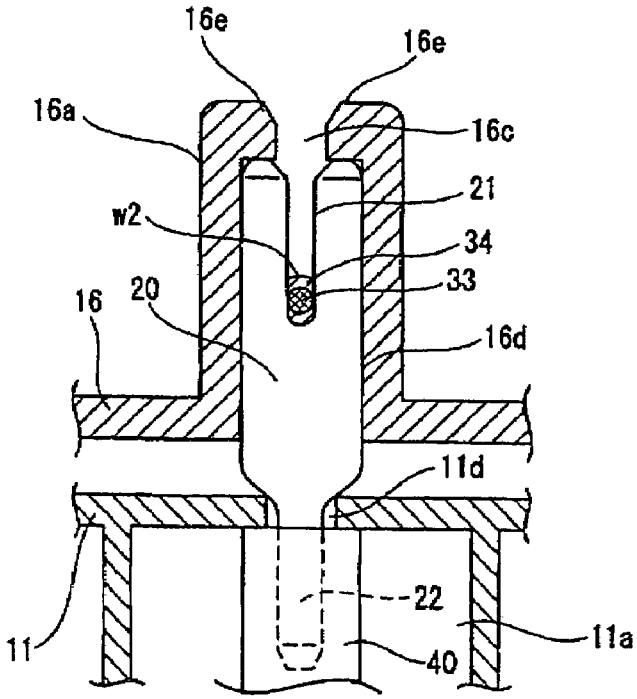

As shown in FIGS. 6A through 6C, the connection between thin wire w2 and pressure contact terminal 20 is essentially the same as that for thick wire w1, except that thin wire w2 is not compressed when pressed into wire guide 16*a* and gripped by pressure contact terminal 20 due to width dimension "L" of wire insertion space 16*c* being approximately the same as the diameter of thin wire w2 as shown in FIGS. 6A and 6B. Moreover, external terminal connector 22 of pressure contact terminal 20, to which thin wire w2 connects, may project into connector compartment 11*a*, fuse compartment 11*b* or relay compartment 11*c*, and connect to an external terminal.

This construction of the present invention allows a commonly dimensioned pressure contact terminal 20 to grip either thick wire w1 or thin wire w2. As a result of core wire 31 being made from multiple twisted wire strands 30, the insertion of thick wire w1 into wire insertion space 16*c*, which is the approximate same width as thin wire w2, results in the distortion of thick wire w1 into an oval cross section, thereby allowing thick wire w1 to be pressed into and gripped by pressure contact terminal 20. This structure is thus able to lower the manufacturing cost of pressure contact terminals 20, reduce the number of required components, and simplify the process through which wires are joined to pressure contact terminals 20 because either thick wire w1 or thin wire w2 may be connected to a single type of pressure contact terminal 20. Furthermore, although this embodiment describes one type of pressure contact terminal that connects to either thick wire w1 or thin wire w2, the slots and external terminals of the pressure contact terminals may be structured to various lengths providing that the width of the slot remains uniform. Also, while this embodiment describes the pressure contact terminal as being commonly connectable to either thick wire w1 or thin wire w2, a structure may also be employed wherein a slot cut into a bus bar, the bus bar having been press-blanked and bend-formed from electrically conductive sheet metal, is also able to connect to either thick wire w1 or thin wire w2.

Figure 7:
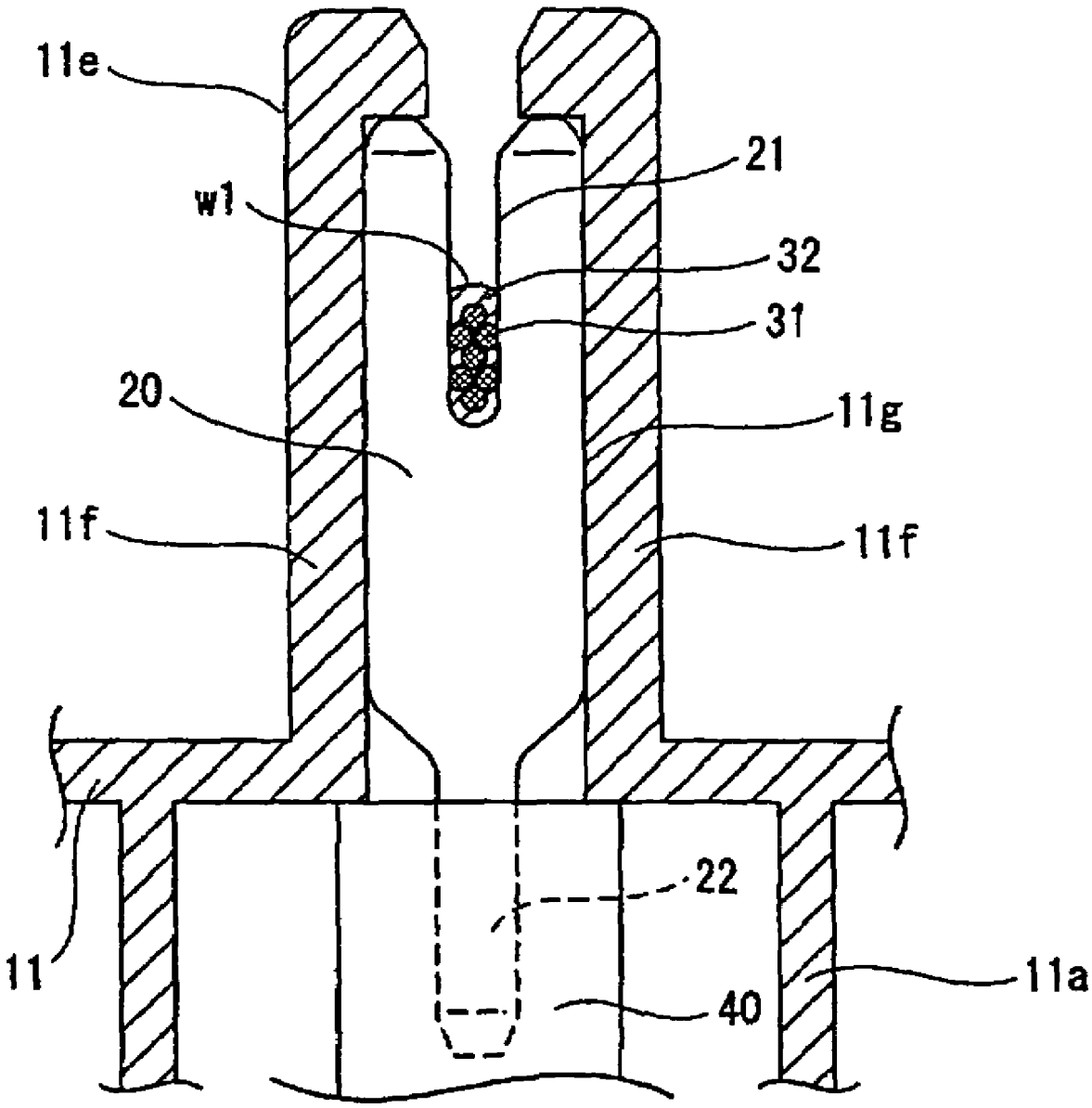
FIG. 7 is a cross sectional view of a modified version of the pressure contact terminal chamber of the embodiment FIG. 1.

FIG. 7 illustrates a variation of the first embodiment wherein wire guide 11*e*, into which thick wire w1 or thin wire w2 is placed, is constructed from sidewalls 11*f* projecting from the internal side of upper case 11. As described in the first embodiment, external terminal connector 22 of pressure contact terminal 20, which is housed within pressure contact terminal chamber 11*g* formed within a specific part of wire guide 11*e*, projects into connector compartment 11*a* which is formed on an external side of upper case 11. Descriptions have been omitted for the structures and mechanisms of this modified embodiment that share common identifying numbers with the first embodiment.

Figure 8A:
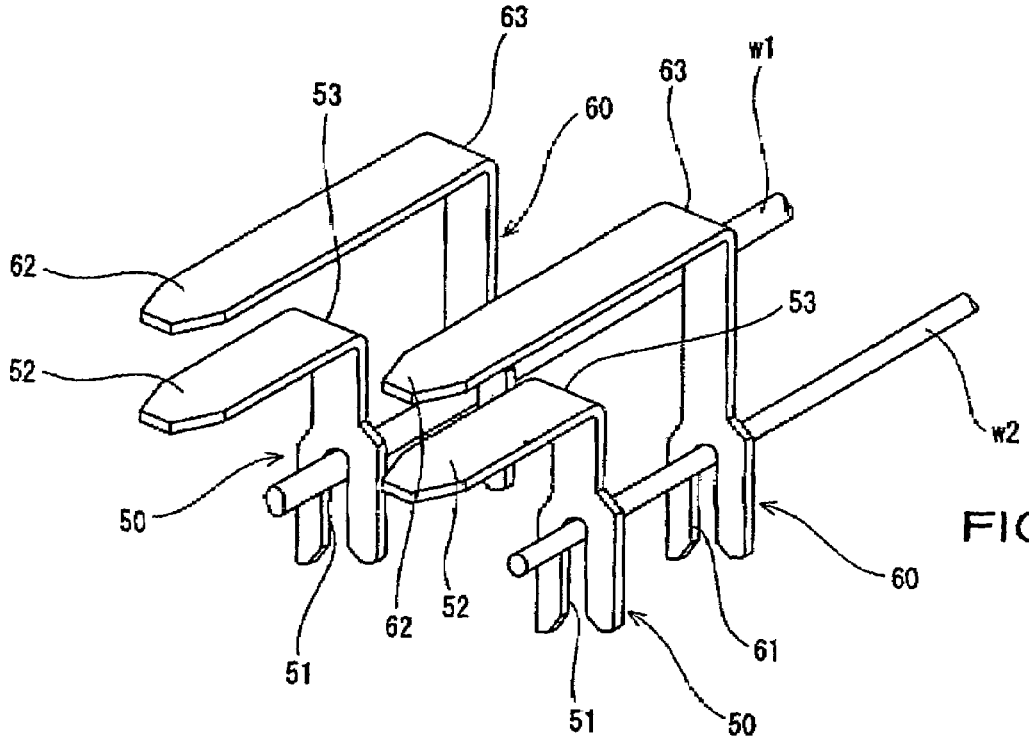
FIG. 8A is a perspective view of wires inserted into pressure contact terminals of a second embodiment of the present invention.
Figure 8B:
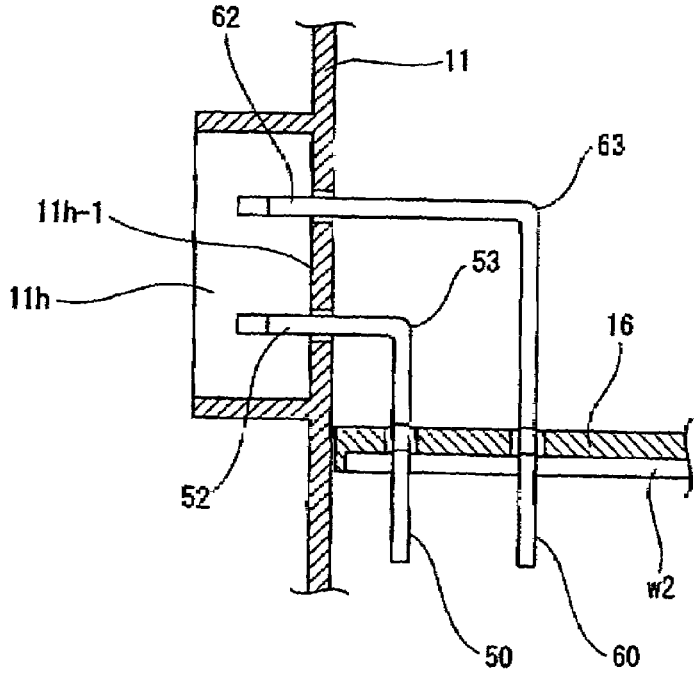
FIG. 8B a cross sectional view of wires inserted into the pressure contact terminals of the embodiment of FIG. 8A.
Figure 9:
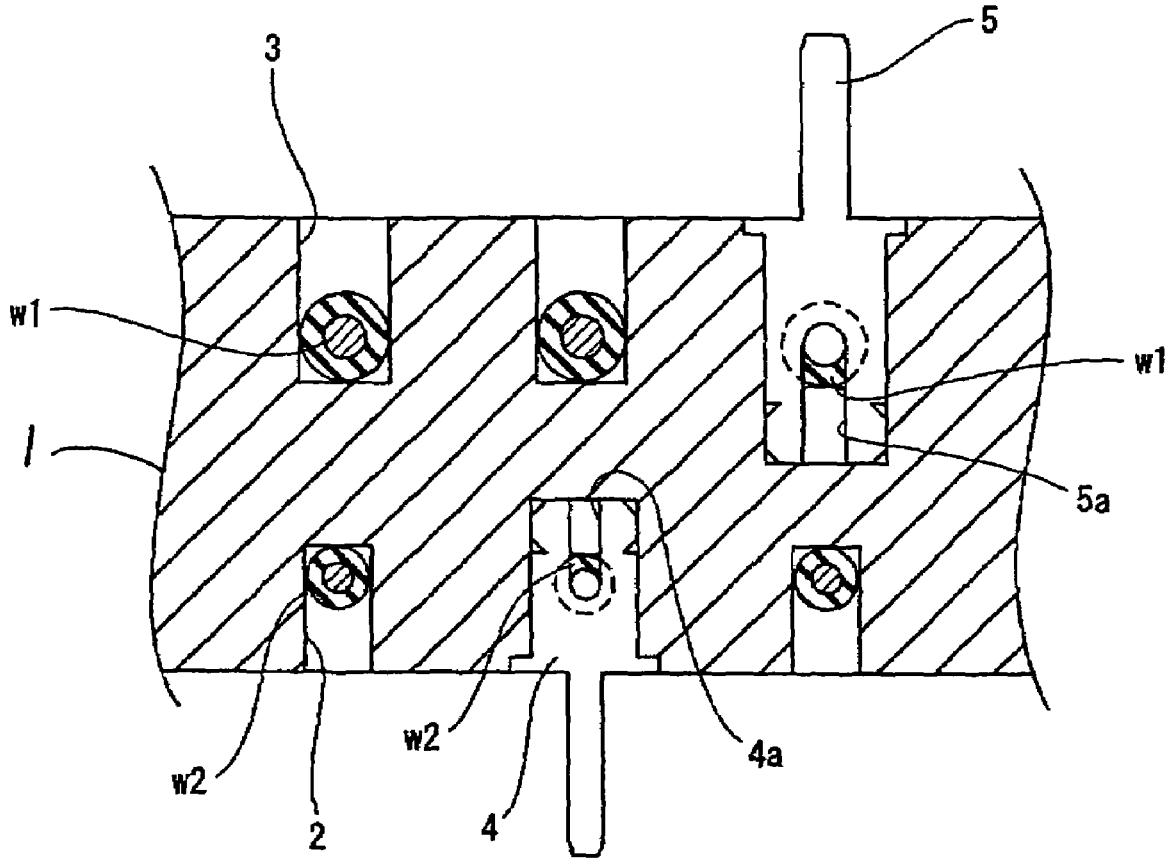
FIG.9 Prior Art
FIG. 9 is cross sectional view of a conventional pressure contact terminal structure.

FIGS. 8A and 8B illustrate a second embodiment of the present invention including pressure contact terminals 50 and 60 in which slots 51 and 61 are provided on one end, and external terminals 52 and 62 are provided on the other end. Although similar to pressure contact terminal 20 of the first embedment, pressure contact terminals 50 and 60 include a 90 degree angle between slots 51 and 61 and external terminal portions 52 and 62. The angle in the pressure contact terminals 50, 60 may be formed in any suitable manner and in the present embodiment have been bend formed 90 degrees between slots 51, 61 and external terminal parts 52, 62. On pressure contact terminal 50, the distance from the end of slot 51 to bent portion 53, and the distance from external terminal 52 to bent portion 53 are of a shorter dimension. On pressure contact terminal 60, the distance from the end of slot 61 to bent portion 63, and the distance from external terminal 62 to bent portion 63 of pressure contact terminal 60 are of a longer dimension.

As illustrated in FIG. 8A, pressure contact terminals 50 and 60 respectively grip thick wire w1 and thin wire w2 on the underside of insulator board 16 in the same manner as described for the first embodiment. As illustrated in FIG. 8B, external terminals 52 and 62 of pressure contact terminals 50 and 60 project horizontally into connector compartment 11*h* which is formed on the side of upper case 11, and connect to terminals within connector compartment 11*h*. External terminal 52 of pressure contact terminal 50 and external terminal 62 of pressure contact terminal 60 extend into connector compartment 11*h* an equal distance from floor 11*h*–1.

This construction of the present invention, whereby two pairs of pressure contact terminals are able to respectively grip thick wire w1 and thin wire w2, and whereby external terminals project into horizontally facing connector compartment 11*h*, would normally necessitate the manufacture of four different types of pressure contact terminals if each slot were dimensioned to grip only a thick wire w1 or only a thin wire w2. However, because the present invention allows pressure contact terminals 50 and 60 to be constructed to grip either thick wire w2 or thin wire w21, only two types of pressure contact terminals 50 and 60 need be used to achieve the same ends, this reducing the number of pressure contact terminal types required.

Descriptions have been omitted for the structures and mechanisms of this second embodiment that share element numbers with the first embodiment.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. An electrical connector box including a case to house insulation covered electrical wires, said electrical connector box comprising:

a plurality of pressure contact terminals provided in said case, each said pressure contact terminal comprising a slot to hold an electrical wire and make connection thereto;

wherein each said slot is configured having a first width dimension, said first width dimension accommodating a thick insulated electrical wire or a thin insulated electrical wire;

wherein each slot is configured to a common width dimension configured to hold the thick insulated electrical wire having a core formed of multiple twisted strands or the thin insulated electrical wire having a core formed of a single strand;

wire guide channels configured to route the electrical wires therealong, said wire guide channels including two walls projecting from an inner surface of said case or from said insulator board;

pressure contact terminal chambers provided on said case or said insulator board, said pressure contact terminals contained within said pressure contact terminal chambers, said pressure contact terminal chambers being formed as a widened space between said two walls;

closing walls provided at the top of said two walls defining a wire insertion space for insertion of the electrical wire;

wherein the electrical wire in the wire guide channel may be compressed by passing through said wire insertion space and pressed into said slot of said pressure contact terminal to make contact therewith; and an external connector portion of said pressure contact terminal, said external connector portion projecting from an end of said pressure contact terminal chamber and configured to connect to terminals contained in a connector compartment, fuse compartment, or relay compartment on an external side of said case.

2. The electrical connector box according to claim 1, wherein said electrical connector box is configured to be received in an automobile.

3. The electrical connector box according to claim 1, wherein the core of the thick wire includes a cross sectional area 1.5 to 3 times larger than the cross sectional area of the core of the thin wire.

4. The electrical connector box according to claim 1, further comprising:

an insulator board provided in said case;

wherein said wire insertion space is configured to a width substantially equal to the diameter of the thin electrical wire; and wherein the thick electrical wire may be pressed into one of said slots after being compressed to the same diameter as the diameter of the thin electrical wire.

5. The electrical connector box according to claim 2, further comprising:

an insulator board provided in said case;

wherein said wire insertion space is configured to a width substantially equal to the diameter of the thin electrical wire; and wherein the thick electrical wire may be pressed into one of said slots after being compressed to the same diameter as the diameter of the thin electrical wire.

6. The electrical connector box according to claim 1, wherein the width of said wire insertion space between said closing walls is smaller than the width of said widened space between said two walls.

7. The electrical connector box according to claim 1, wherein said closing walls project toward each oilier so that the width of said wire insertion space between said closing walls is smaller than the width of said widened space between said two walls.

8. An electrical connector box including a case to house insulation covered electrical wires, said electrical connector box comprising:

at least one pressure contact terminal provided in said case, each said pressure contact terminal comprising a slot to hold an electrical wire and make connection thereto;

wherein each said slot is configured having a first width dimension, said first width dimension accommodating a thick insulated electrical wire or a thin insulated electrical wire;

wire guide channels configured to route the electrical wires therealong, said wire guide channels including two walls projecting from an inner surface of said case or from said insulator board;

pressure contact terminal chambers provided on said case or said insulator board, said pressure contact terminals contained within said pressure contact terminal chambers, said pressure contact terminal chambers being formed as a widened space between said two walls;

closing walls provided at the top of said two walls defining a wire insertion space for insertion of the electrical wire;

wherein the electrical wire in the wire guide channel may be compressed by passing through said wire insertion space and pressed into said slot of said pressure contact terminal to make contact therewith; and an external connector portion of said pressure contact terminal, said external connector portion projecting from an end of said pressure contact terminal chamber and configured to connect to terminals contained in a connector compartment, fuse compartment, or relay compartment on an external side of said case.

* * * * *